US006053385A

United States Patent [19]

Ward et al.

[11] Patent Number: 6,053,385

[45] Date of Patent: Apr. 25, 2000

[54] BACKPACK WITH UMBRELLA SUPPORT

[76] Inventors: Janet Ward; Ken DeBono, both of 4116 Merrick, Dearborn Heights, Mich. 48125

[21] Appl. No.: 09/283,879

[22] Filed: Apr. 1, 1999

[51] Int. Cl.[7] ..... A45C 15/00

[52] U.S. Cl. ..... 224/576; 224/153; 224/186; 224/188; 224/189; 224/915

[58] Field of Search ..... 224/576, 915, 224/153, 200, 645, 186, 188, 189, 650, 628, 630

[56] References Cited

U.S. PATENT DOCUMENTS

| | | | |
|---|---|---|---|
| 1,657,263 | 1/1928 | Lauby . | |
| 2,085,984 | 7/1937 | Kruithof . | |
| 2,610,778 | 9/1952 | Young . | |
| 3,120,332 | 2/1964 | White | 224/189 |
| 3,263,878 | 8/1966 | Pratt . | |
| 5,004,134 | 4/1991 | Barry | 224/576 |
| 5,263,837 | 11/1993 | Dompe | 224/190 |
| 5,353,977 | 10/1994 | Schiro, Jr. et al. . | |
| 5,513,786 | 5/1996 | Drane . | |

*Primary Examiner*—Gregory M. Vidovich
*Assistant Examiner*—Maerena W. Brevard
*Attorney, Agent, or Firm*—Joseph N. Breaux

[57] ABSTRACT

A backpack that includes an umbrella support assembly and an umbrella. The umbrella is storable within an umbrella storage compartment provided along an entire side edge of the backpack. The collapsible rain canopy is sized to shield the back pack and the user from rain when deployed.

1 Claim, 4 Drawing Sheets

FIG. 1
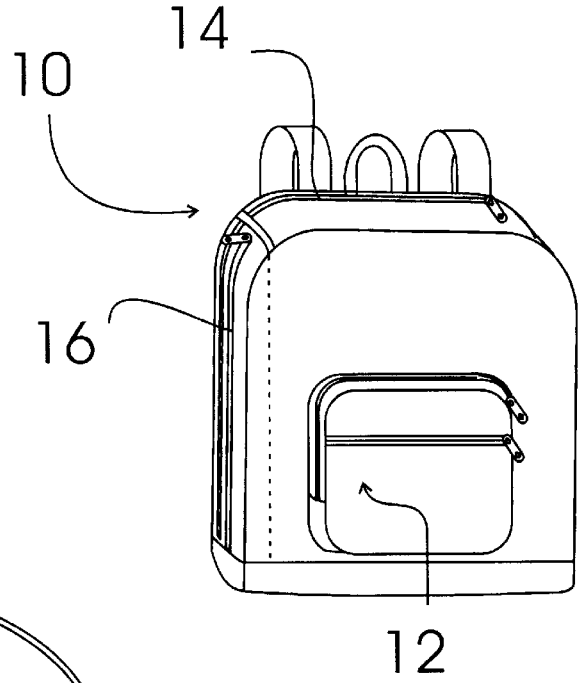
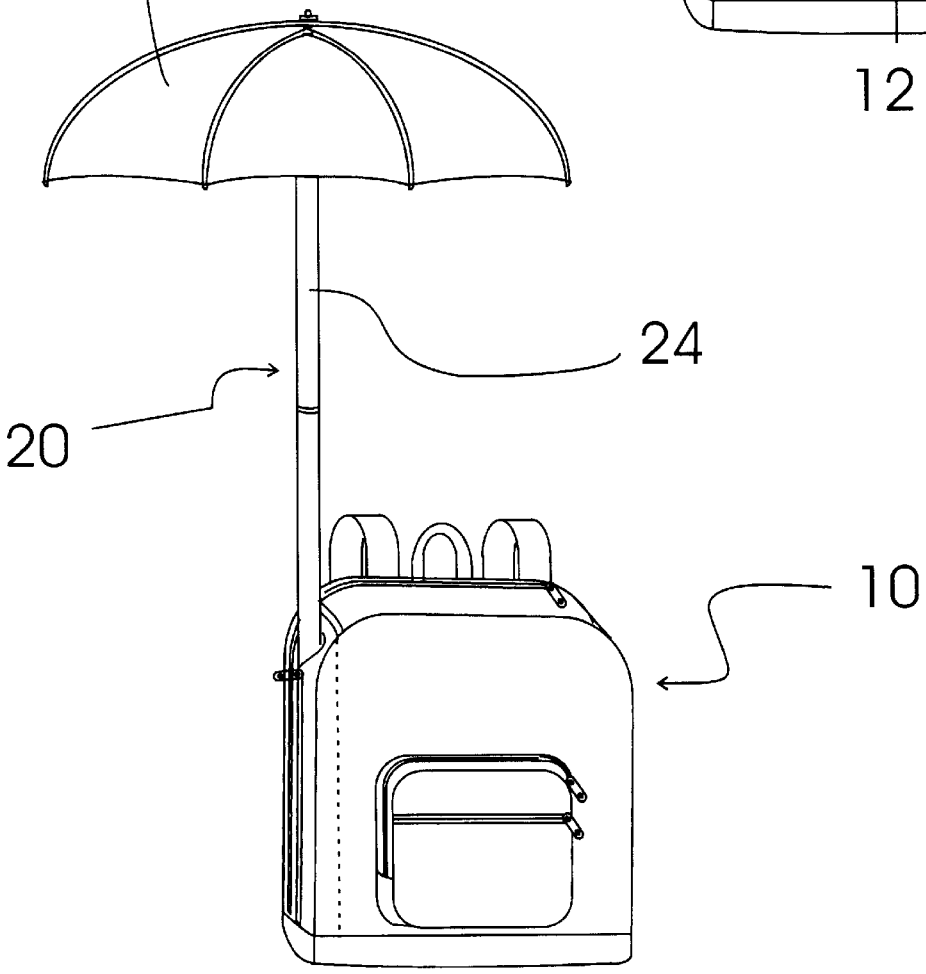
FIG. 2

BACKPACK WITH UMBRELLA SUPPORT

TECHNICAL FIELD

The present invention relates to backpacks and the like and more particularly to a backpack with an umbrella support that includes an umbrella support assembly, a backpack assembly, and an umbrella; the umbrella including a telescoping shaft that is attached to a collapsible rain canopy at one end and a handle at the other end; the backpack assembly being of fabric construction and having defined therein an umbrella storage compartment provided along an entire side edge thereof and a backpack item carrying compartment adjacent to the umbrella storage compartment, the umbrella storage compartment being accessible through an opening sealable with a closure mechanism; the umbrella support assembly including a rigid I-shaped frame member having two bottom legs and two top legs, an umbrella handle receiving cup secured to one of the bottom legs, an umbrella handle securing strap attached to one of the bottom legs, and two adjustable shoulder straps; the rigid I shaped frame member being positioned within the backpack item carrying compartment; the umbrella handle receiving cup and the umbrella handle securing strap being positioned within a bottom portion of the umbrella storage compartment; each of the two adjustable shoulder straps being secured between a bottom leg and a top leg of the rigid I-shaped frame member; the umbrella handle receiving cup being sized to receive therein a bottom portion of the umbrella handle; the umbrella being sized to fit entirely within the umbrella storage compartment when in a collapsed configuration; the collapsible rain canopy being sized to shield the back pack assembly from rain when deployed.

BACKGROUND ART

It is often difficult to carry an umbrella and simultaneously perform a job or carry items. It would be a benefit, therefore to have a backpack with an umbrella support that supported an umbrella with a deployed rain canopy to free the hands of the user to perform other activities.

GENERAL SUMMARY DISCUSSION OF INVENTION

It is thus an object of the invention to provide a backpack with an umbrella support.

It is a further object of the invention to provide a backpack with umbrella support that includes an umbrella support assembly, a backpack assembly, and an umbrella; the umbrella including a telescoping shaft that is attached to a collapsible rain canopy at one end and a handle at the other end; the backpack assembly being of fabric construction and having defined therein an umbrella storage compartment provided along an entire side edge thereof and a backpack item carrying compartment adjacent to the umbrella storage compartment, the umbrella storage compartment being accessible through an opening sealable with a closure mechanism; the umbrella support assembly including a rigid I-shaped frame member having two bottom legs and two top legs, an umbrella handle receiving cup secured to one of the bottom legs, an umbrella handle securing strap attached to one of the bottom legs, and two adjustable shoulder straps; the rigid I shaped frame member being positioned within the backpack item carrying compartment; the umbrella handle receiving cup and the umbrella handle securing strap being positioned within a bottom portion of the umbrella storage compartment; each of the two adjustable shoulder straps being secured between a bottom leg and a top leg of the rigid I-shaped frame member; the umbrella handle receiving cup being sized to receive therein a bottom portion of the umbrella handle; the umbrella being sized to fit entirely within the umbrella storage compartment when in a collapsed configuration; the collapsible rain canopy being sized to shield the back pack assembly from rain when deployed.

Accordingly, a backpack with umbrella support is provided. The backpack with umbrella support includes an umbrella support assembly, a backpack assembly, and an umbrella; the umbrella including a telescoping shaft that is attached to a collapsible rain canopy at one end and a handle at the other end; the backpack assembly being of fabric construction and having defined therein an umbrella storage compartment provided along an entire side edge thereof and a backpack item carrying compartment adjacent to the umbrella storage compartment, the umbrella storage compartment being accessible through an opening sealable with a closure mechanism; the umbrella support assembly including a rigid I-shaped frame member having two bottom legs and two top legs, an umbrella handle receiving cup secured to one of the bottom legs, an umbrella handle securing strap attached to one of the bottom legs, and two adjustable shoulder straps; the rigid I shaped frame member being positioned within the backpack item carrying compartment; the umbrella handle receiving cup and the umbrella handle securing strap being positioned within a bottom portion of the umbrella storage compartment; each of the two adjustable shoulder straps being secured between a bottom leg and a top leg of the rigid I-shaped frame member; the umbrella handle receiving cup being sized to receive therein a bottom portion of the umbrella handle; the umbrella being sized to fit entirely within the umbrella storage compartment when in a collapsed configuration; the collapsible rain canopy being sized to shield the back pack assembly from rain when deployed.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the backpack with umbrella support of the present invention showing the backpack assembly including the two shoulder straps, the two backpack item carrying compartments, and the umbrella storage compartment.

FIG. 2 is a perspective view of the exemplary backpack with umbrella support of FIG. 1 with the umbrella canopy of the umbrella deployed from its storage location within the umbrella storage compartment and supported by the telescoping umbrella shaft over the backpack assembly.

EXEMPLARY MODE FOR CARRYING OUT THE INVENTION

Figure 3:
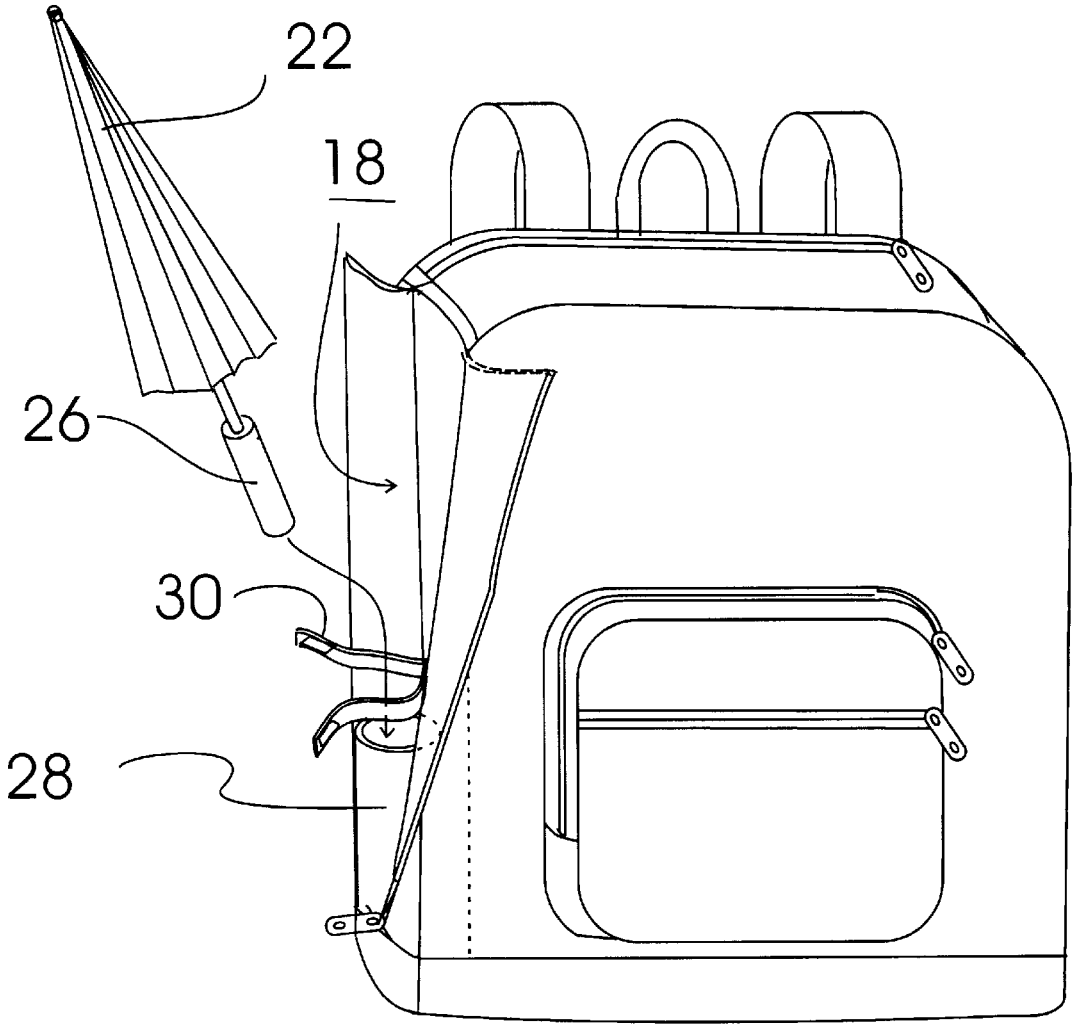
FIG. 3 is a perspective view of the exemplary backpack with umbrella support of FIG. 1 with the zipper closure of the umbrella storage compartment unzipped and the umbrella with telescoping umbrella shaft removed to show the umbrella handle receiving cup and the umbrella handle securing strap of the umbrella support assembly positioned at the bottom of the umbrella storage compartment.
Figure 4:
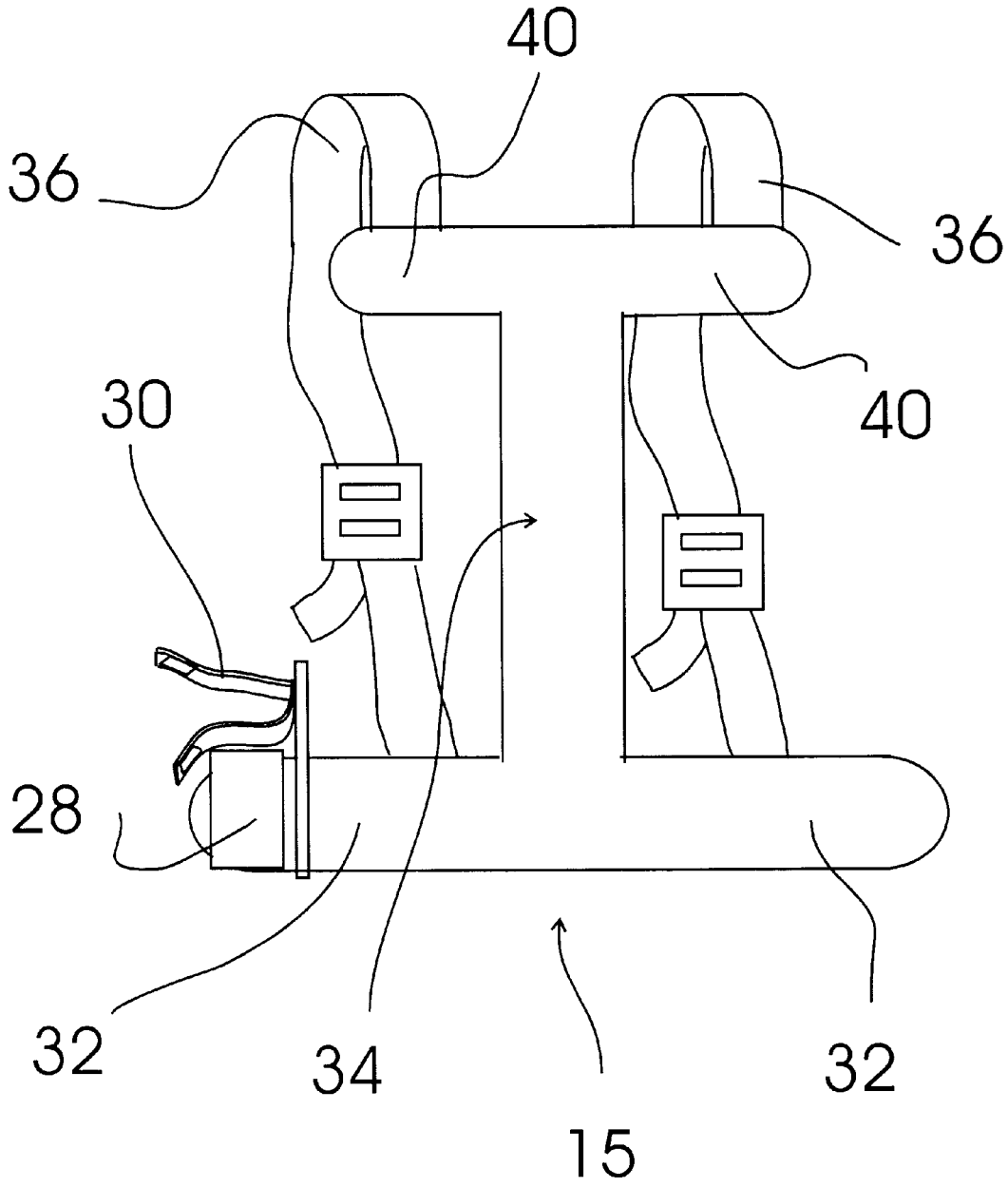
FIG. 4 is a perspective view of the umbrella support assembly in isolation showing the I-shaped frame member, the umbrella handle receiving cup and the umbrella handle securing strap attached to a bottom leg of the I-shaped frame member, and the two adjustable shoulder straps each secured between a bottom leg and a top leg of the I-shaped frame member.
Figure 5:
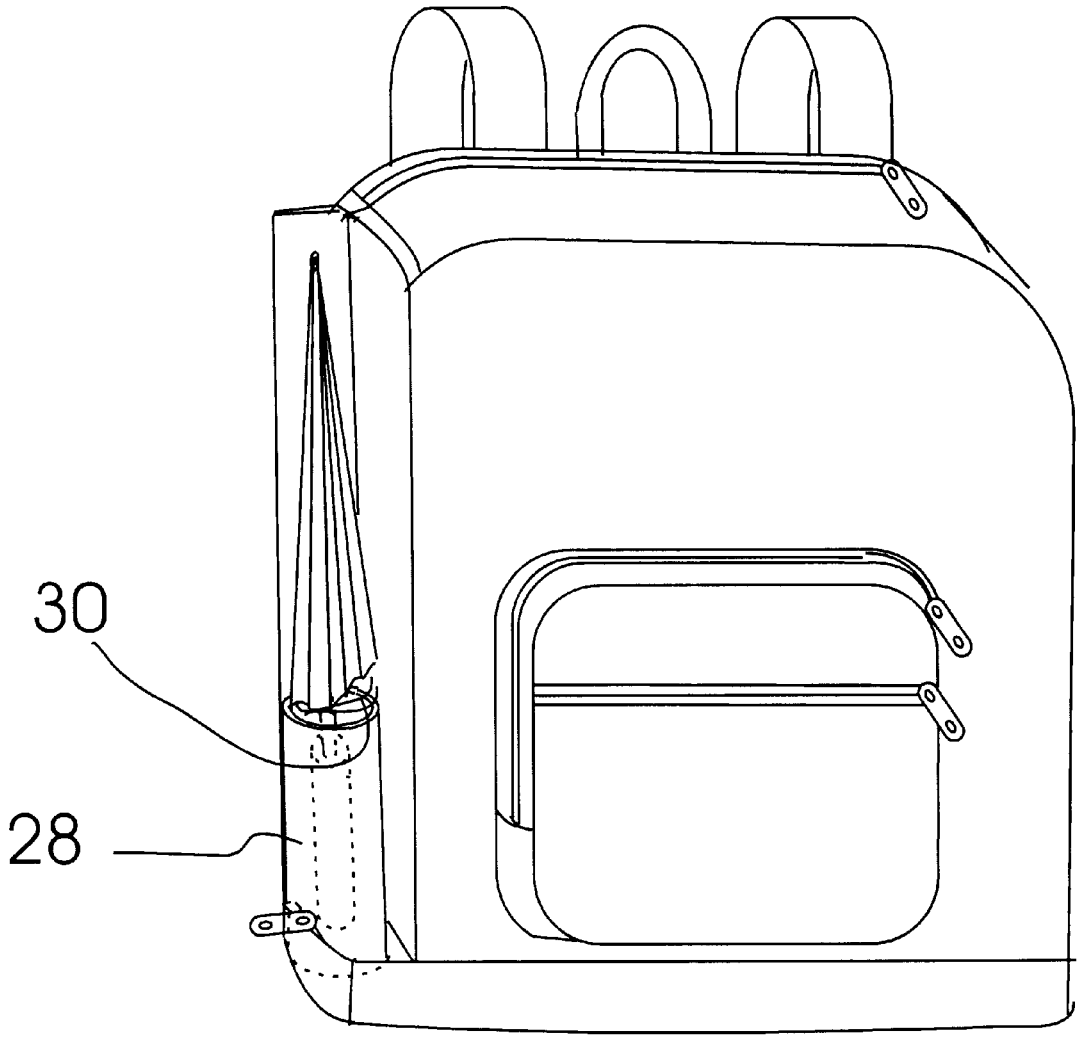
FIG. 5 is a perspective view of the exemplary backpack with umbrella support of FIG. 1 with a portion of the backpack assembly cut away to reveal the interior of the umbrella storage compartment with the end of the umbrella handle positioned within the umbrella handle receiving cup of the umbrella support assembly and the top portion of the umbrella handle secured by the umbrella handle securing strap of the umbrella support assembly.

FIG. 1 shows an exemplary embodiment of the backpack with umbrella support of the present invention generally designated 10. Backpack with umbrella support 10 includes a backpack assembly, generally designated 12; an umbrella, generally designated 20 (FIG. 2); and an umbrella support assembly, generally designated 15 (FIG. 4). Backpack assembly 12 is of stitched fabric construction and includes an item carrying compartment zipper 14 in connection with an item carrying compartment 17 formed within backpack assembly 12 and an umbrella compartment zipper 16 in connection with an umbrella compartment 18 (FIG. 3) formed along the entire side edge of backpack assembly 12. Referring to FIG. 2, umbrella 20 includes a collapsible canopy 22, a telescoping shaft 24, and referring now to FIG. 3, a handle 26. In use, handle 26 is inserted within an umbrella handle receiving cup 28 (see also FIG. 5) and secured with an umbrella handle securing strap 30 (see also FIG. 5) that are both positioned at the bottom of the umbrella storage compartment 18.

With reference to FIG. 4, umbrella handle receiving cup 28 and umbrella handle securing strap 30 are both attached to a bottom leg of a molded plastic, I-shaped frame member, generally designated 34. Umbrella handle receiving cup 28, umbrella handle securing strap 30 and I-shaped frame member 34 together with two adjustable straps 36 form umbrella support assembly 15. Adjustable straps 36 are secured between bottom legs 32 and top legs 40 of I-shaped frame member 34. During construction, I-shaped frame member 34 is installed within item carrying compartment 17 (FIG. 1 in dashed lines). Adjustable straps 36 extend out of item carrying compartment 17 through a back contacting surface of backpack assembly 12 for positioning over the shoulders of a user.

It can be seen from the preceding description that a backpack with umbrella support has been provided that includes an umbrella support assembly, a backpack assembly, and an umbrella; the umbrella including a telescoping shaft that is attached to a collapsible rain canopy at one end and a handle at the other end; the backpack assembly being of fabric construction and having defined therein an umbrella storage compartment provided along an entire side edge thereof and a backpack item carrying compartment adjacent to the umbrella storage compartment, the umbrella storage compartment being accessible through an opening sealable with a closure mechanism; the umbrella support assembly including a rigid I-shaped frame member having two bottom legs and two top legs, an umbrella handle receiving cup secured to one of the bottom legs, an umbrella handle securing strap attached to one of the bottom legs, and two adjustable shoulder straps; the rigid I shaped frame member being positioned within the backpack item carrying compartment; the umbrella handle receiving cup and the umbrella handle securing strap being positioned within a bottom portion of the umbrella storage compartment; each of the two adjustable shoulder straps being secured between a bottom leg and a top leg of the rigid I-shaped frame member; the umbrella handle receiving cup being sized to receive therein a bottom portion of the umbrella handle; the umbrella being sized to fit entirely within the umbrella storage compartment when in a collapsed configuration; the collapsible rain canopy being sized to shield the back pack assembly from rain when deployed.

It is noted that the embodiment of the backpack with umbrella support described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A backpack with umbrella support comprising:

an umbrella support assembly;

a backpack assembly; and an umbrella;

said umbrella including a telescoping shaft that is attached to a collapsible rain canopy at one end and a handle at the other end;

said backpack assembly being of fabric construction and having defined therein an umbrella storage compartment provided along an entire side edge thereof and a backpack item carrying compartment adjacent to said umbrella storage compartment, said umbrella storage compartment being accessible through an opening sealable with a closure mechanism;

said umbrella support assembly including a rigid I-shaped frame member having two bottom legs and two top legs, an umbrella handle receiving cup secured to one of said bottom legs, an umbrella handle securing strap attached to one of said bottom legs, and two adjustable shoulder straps;

said rigid I shaped frame member being positioned within said backpack item carrying compartment;

said umbrella handle receiving cup and said umbrella handle securing strap being positioned within a bottom portion of said umbrella storage compartment;

each of said two adjustable shoulder straps being secured between one of a respective bottom leg and one of a respective top leg of said rigid I-shaped frame member;

said umbrella handle receiving cup being sized to receive therein a bottom portion of said umbrella handle;

said umbrella being sized to fit entirely within said umbrella storage compartment when in a collapsed configuration;

said collapsible rain canopy being sized to shield said back pack assembly from rain when deployed.

* * * * *